United States Patent [19]

Kuehnle

[11] 4,259,005

[45] Mar. 31, 1981

[54] DEVICE AND METHOD FOR DEVELOPING LATENT ELECTROSTATIC IMAGES

[75] Inventor: Manfred R. Kuehnle, Lexington, Mass.

[73] Assignee: Coulter Systems Corporation, Bedford, Mass.

[21] Appl. No.: 965,328

[22] Filed: Dec. 1, 1978

[51] Int. Cl.[3] ..... G03G 15/10

[52] U.S. Cl. ..... 355/10; 118/661; 354/318; 430/103; 430/119

[58] Field of Search ..... 355/3 R, 10; 354/298, 354/318, 331; 427/15, 17; 118/651, 659, 661; 430/103, 117, 118, 119

[56] References Cited

U.S. PATENT DOCUMENTS

| | | | |
|---|---|---|---|
| 3,147,366 | 9/1964 | Dreyfoos | 354/331 X |
| 3,169,887 | 2/1965 | York | 118/661 |
| 3,774,574 | 11/1973 | Sato et al. | 355/10 X |
| 3,839,032 | 10/1974 | Smith et al. | 355/10 X |
| 3,849,171 | 11/1974 | Takahashi et al. | 427/15 |
| 3,913,119 | 10/1975 | Pfeifer et al. | 354/298 X |
| 3,943,268 | 3/1976 | Sato | 355/10 X |

*Primary Examiner*—Fred L. Braun

*Attorney, Agent, or Firm*—Silverman, Cass & Singer, Ltd.

[57] ABSTRACT

A device for use in developing a latent electrostatic image formed on the image bearing surface of an electrophotographic belt as the belt is moving through an arcuate path includes a container having a quantity of liquid toner. The container includes a top wall that has a centrally located slot and that is shaped to conform to the shape of the top wall. A development electrode is located on the top surface of the top wall. A feed roller is rotatably mounted in the container and positioned so as to project out slightly from the slot in the top wall. In use, the container is positioned with the top wall close to and parallel to the arcuate path of travel of the belt and the feed roller close to but not touching the belt. As the feed roller rotates, liquid toner is brought up close to the belt at which location the toner particles dispersed in the liquid toner are electrically attracted to and deposit on the charged portions of the belt.

9 Claims, 2 Drawing Figures

DEVICE AND METHOD FOR DEVELOPING LATENT ELECTROSTATIC IMAGES

FIELD OF THE INVENTION

This invention relates to a method and device for developing a latent electrostatic image. More particularly, this invention relates to a method and device for developing a latent electrostatic image formed on the image bearing surface of an electrophotographic belt as said surface is moving through an arcuate path using a liquid toner.

As used throughout the specification and claims, the term "electrophotographic belt" is intended to mean an endless belt or web of which at least a portion thereof is electrophotographic in character; that is, is made of a photoconductive coating on a conductive substrate.

BACKGROUND OF THE INVENTION

The formation and development of an image on the surface of a photoconductive member by electrophotographic means is well known in the art. Basically, the technique involves placing a uniform electrostatic charge on the surface, exposing the charged surface to a pattern of light so as to form thereon a latent electrostatic image and then developing the latent electrostatic image by depositing on the surface finely divided electroscopic material referred to in the art as "toner." The toner is attracted to those areas of the surface retaining the electrostatic charge, thereby forming a toned image. The toned image may either be fixed to the surface of the photoconductive member by heat lamps or other suitable means or transferred to a secondary support surface such as paper and then fixed if desired or necessary.

In some known electrophotographic copying or duplicating machines the photoconductive member is in the form of a drum which rotates in unison relative to a plurality of processing stations. For high speed copying, however, it has been found necessary that the photoconductive surface be in a flattened condition at the time of exposure in order to insure complete focusing of the original being copied. Consequently, it has been found advantageous to employ a photoconductive member in the form of an endless belt or web mounted for rotational movement on a plurality of rollers.

Regardless of whether the photoconductive member is in the form of a drum or a belt mounted on rollers, the latent electrostatic image so formed can be developed into a visible image by using any one of several known techniques; these include cascade development, magnetic brush development and liquid development. In liquid development a dispersion of electroscopic particles in an insulating liquid is employed and the electrostatic image developed by deposition of particles from the liquid to the photoconductive surface. In such development the liquid containing the particles contacts the photoconductive surface in both the charged and uncharged areas. Under the influence of the electric field associated with the charged image pattern, the suspended particles migrate toward the charged portions of the surface separating out of the insulating liquid. The electrophoretic migration of charged particles results in the deposition of charged particles on the imaging surface in an image configuration. Such development has been obtained in the past by flowing the liquid developer over the image bearing surface, by immersing the image bearing surface in a bath of the developer liquid and by presenting the developer liquid on a smooth surfaced roller and moving the roller against the imaging surface. In connection with these various techniques, it is known that the development can be improved, especially if the image contains large solid areas, through the use of what is known in the art as a development electrode.

In U.S. Pat. No. 4,025,339 issued on May 24, 1977 to M. R. Kuehnle there is described an electrophotographic film that is capable of being imaged with quality and gray scale, as good as, if not better than, that achieved by photographic techniques. The film comprises an inorganic coating of microcrystalline material that is bonded onto a conductive substrate. The inorganic coating may comprise a layer of about 2,000 Angstroms to 2 microns thick of radio frequency sputtered cadmium sulfide. The conductive substrate may comprise a layer of about 500 Angstroms thick of indium tin oxide on a sheet of stable polyester plastic about 5 microns thick. A latent electrostatic image formed on the film may be developed using a liquid toner.

In order to make the fullest use of the exceptional properties of the electrophotographic film described in the above noted patent, especially for high speed duplicating or copying machine applications, there is a need for a simple yet efficient technique for developing a latent electrostatic image formed thereon using a liquid toner.

SUMMARY OF THE INVENTION

A device for use in developing a latent electrostatic image formed on the image bearing surface of an electrophotographic belt as the surface is moving through a predetermined arcuate path includes a container having therein a quantity of liquid toner. The container includes an arcuate shaped top wall that is made of conductive material so as to function as a development electrode and is provided with a centrally located longitudinal slot. The radius of curvature of the top wall is equal to the radius of curvature of the arcuate path. In use the container is positioned so that the top wall is very close to, but not touching, and parallel to the arcuate path. Liquid toner is brought up from the container to the vicinity of the electrophotographic belt by means of a motor driven feed roller which is suitably positioned inside the container.

Various features and advantages of the invention will become apparent on reading the following detailed description and when taken in conjunction with the accompanying drawings.

DESCRIPTION OF THE DRAWINGS

In the drawings wherein like reference numerals represent like parts.

DESCRIPTION OF PREFERRED EMBODIMENTS

Figure 1:
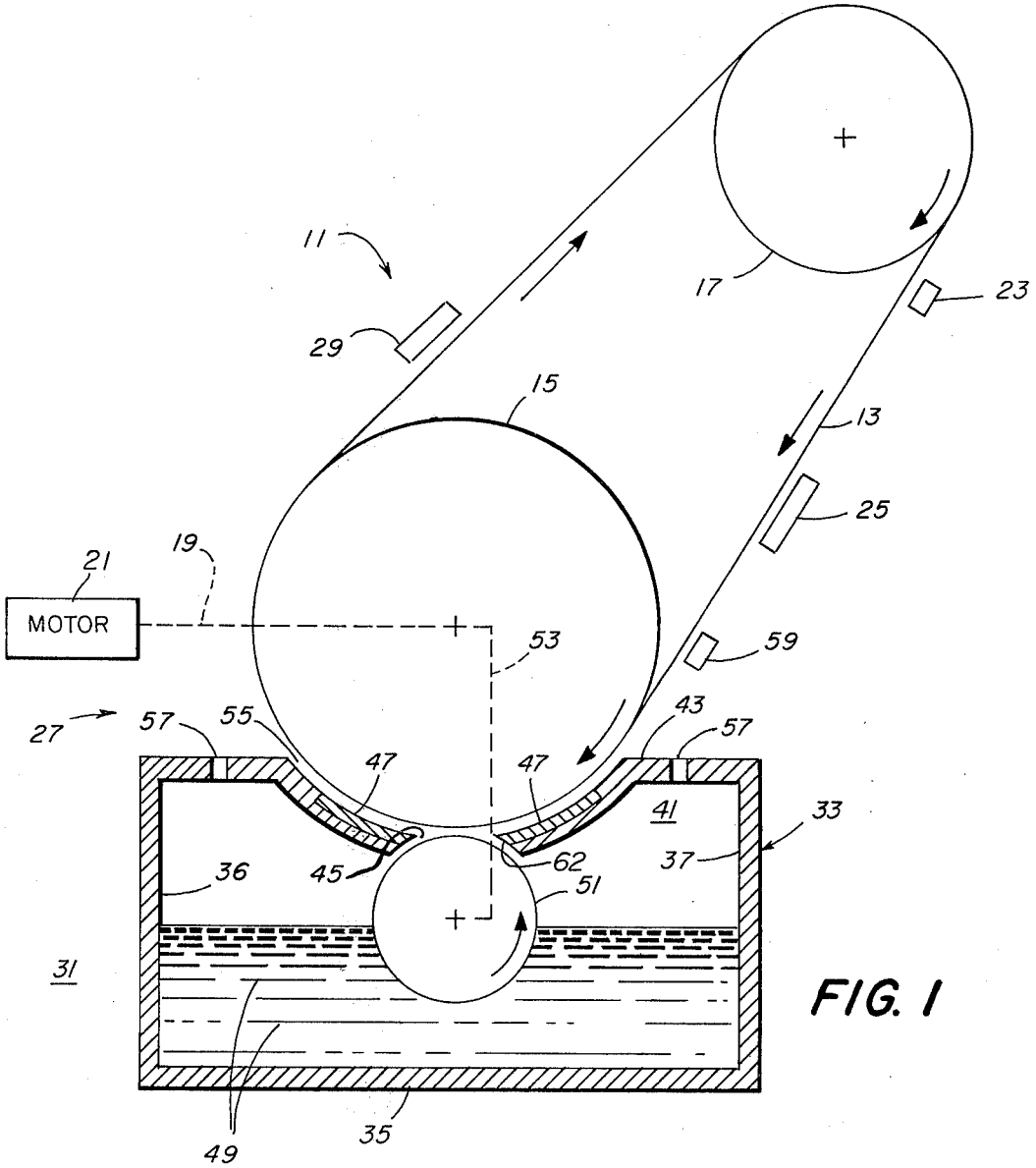
FIG. 1 is a schematic view, partly in section, of an electrophotographic apparatus including a developing device constructed according to this invention.

Referring now to the drawings, there is illustrated in FIG. 1 in simplified schematic form an electrophotographic copying apparatus identified generally by reference numeral 11. It is to be understood that the particular type of electrophotographic apparatus hereinafter described is for illustrative purposes only and that it is not considered as limiting or as a part of this invention.

Apparatus 11 includes an electrophotographic belt 13 mounted on rollers 15 and 17, roller 15 being the drive roller and being mechanically connected through a linkage 19 to a drive motor 21. Roller 15 is arranged to produce rotational movement of belt 13 in the direction shown by the arrows and cause the outer photoconductive surface of belt 13 to sequentially pass through a series of processing stations.

These stations include a charging station 23 at which a uniform electrostatic charge is deposited on the photoconductive surface of the belt 13, an exposure station 25 at which a light pattern of copy to be reproduced is projected onto the photoconductive surface forming thereby a latent electrostatic image, a developing station 27 at which the latent electrostatic image is developed or made visible, and a transfer station 29 at which the developed image is transferred to a secondary material such as a sheet of paper.

At the developing station 27 there is located a developing device 31 according to this invention.

Developing device 31 includes an elongated container 33 positioned so as to extend transversely to the direction of travel of belt 13 and sized so as to span the width of belt 13.

Figure 2:
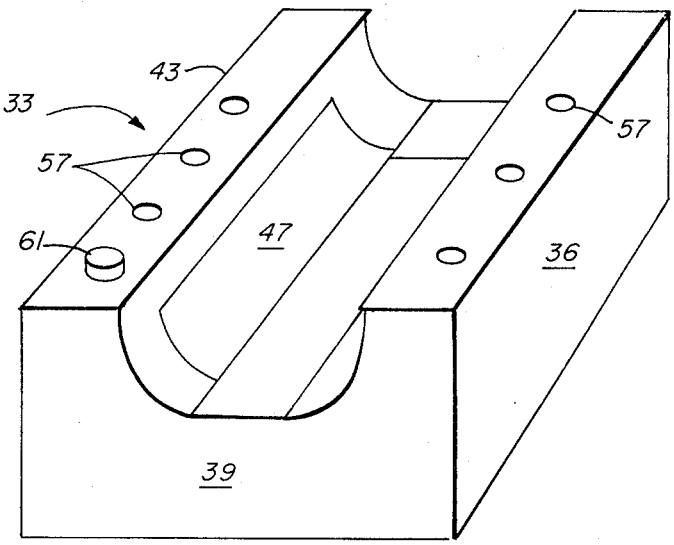
FIG. 2 is a perspective view of the container portion of the developing device shown in FIG. 1.

Container 33, which is shown in perspective in FIG. 2, is made of rigid material and includes a bottom wall 35, a pair of side walls 36 and 37, a front wall 39, a back wall 41 and a top wall 43. Front wall 39 is made of a material that is transparent, such as glass or a transparent plastic, so as to provide a visual indication of the level of the liquid inside the container 33. Top wall 43 has a concave arcuate shaped central portion and includes a longitudinally extending, centrally located slot 45. A pair of concave metal plates 47 are mounted on the top wall 43 in suitably formed recesses so as to be flush with the top surface of top wall 43. Plates 47 function as a development electrode. The radius of curvature of the top surface of top wall 43 is equal to the radius of roller 15. Disposed within the container 33 is a quantity of liquid toner 49. A feed roller 51 is rotatably mounted inside container 33 and positioned therein so as to extend out slightly from slot 45. As illustrated in FIG. 1, the edges 62 of the slot 45 are arcuately beveled as are the edges of plates 47 along said slot 45. In this manner an arcuate surface is presented to the circumferential surface of roller 51. Feed roller 51 is connected by a mechanical linkage 53 to drive roller and arranged so as to turn in the direction shown by the arrow. Container 33 is positioned such that the space between the arcuate shaped top wall 43 and the image bearing or bottom surface of belt 13 at the roller 15 is approximately 4 to 6 mils. Feed roller 51 is positioned in container 33 such that the top is approximately 5 to 10 microns from the image bearing or bottom surface of belt 13 at roller 15. Liquid toner 49 is supplied to the container 33 through an opening in the top wall 43 which is covered with a removable cap 61.

Container 33 may further include a submerged toner agitator (not shown) to keep the toner particles dispersed in the liquid toner 49 from settling to the bottom.

In operation, liquid toner 49 will adhere to the periphery of feed roller 51 as it is caused to rotate within container 33 upon the rotation of drive roller 15. As the liquid toner arrives at the top on feed roller 51 the toner particles suspended therein will be electrically attracted to the charged portions of the image bearing surface of belt 13. A toning bias, which may be in the range of about −15 volts, may be applied (by means not shown) between development electrode 47 and belt 13 to assist in toner particles in liquid toner 49 adhering to the latent image on belt 13.

It is to be noted that feed roller 51 does not come into direct physical contact with belt 13.

Excess liquid toner 49 remaining on belt 13 after it passes by feed roller 51 will either drip down into container 33 through the arcuate space 55 between belt 13 and the development electrode 47 or holes 57 in the top wall functioning as vent means or be removed by a suitably positioned extractor roller (not shown).

In order to prevent "fog" buildup on the image bearing surface of belt 15, the image bearing surface is preferably passed through a wetting station 59 located between exposure station 25 and development station 27 where the surface is prewet with clear insulating liquid (i.e., liquid toner without the toner particles).

Although the invention has been described with reference to developing a latent electrostatic image formed on an electrophotographic belt mounted on rollers, it is obvious that the invention is also applicable to developing a latent electrostatic image formed on an electrophotographic drum. Also, the invention is obviously applicable to developing latent electrostatic images formed on a photoconductive surface by means other than charging and exposing, etc.

Many modifications and variations of the present invention are possible in light of the above teachings. It is therefore to be understood that within the scope of the appended claims the invention may be practiced otherwise than as specifically described.

What is claimed is:

1. A device for use in developing a latent electrostatic image formed on the image bearing surface of an electrophotographic belt with liquid toner as said surface is moving through an arcuate path comprising:

a. a generally enclosed container for holding a quantity of liquid toner, said container having a top wall including a concave arcuate shaped recessed top wall portion whose curvature conforms to the configuration of curvature of said arcuate path in which the image bearing surface is moving, said concave arcuate shaped recessed top wall portion being concentric with said arcuate path and closely spaced therefrom to define a uniform toning gap therebetween, said top wall recessed portion having an elongate slot therein;

b. a feed roller rotatably mounted within said container, and arranged relative to said arcuate top wall recessed portion, said elongate slot and the arcuate path traversed by said surface whereby the center axes of each are aligned in a vertical plane taken through the center of said slot, said feed roller being sized and positioned so as to contact the liquid toner in the container and a portion of its circumferential surface extending into said slot to direct liquid toner from within the container to said toning gap yet said roller being spaced from said arcuate path of said surface as the belt moves through said gap.

2. The device of claim 1 wherein the container includes at least a transparent front wall portion to permit viewing the liquid toner level within the container.

3. The device of claim 1 wherein the top wall of the container includes an opening to provide a means for filling the container with liquid toner and removable cap means closing off said opening.

4. The device of claim 1 wherein at least a portion of the arcuate shaped top wall portion is electrically conductive, said electrically conductive portion forming the top surface of said arcuate top wall portion and bordering the longitudinal edges of said slot.

5. The device of claim 1 and vent means formed in the top wall of said container along said slot but spaced from said arcuate wall portion and capable of enabling excess liquid toner from said toning gap to reenter said container.

6. A device for use in developing a latent electrostatic image formed on the image bearing surface of an electrophotographic belt with liquid toner as said image bearing surface is moving through a predetermined arcuate path comprising:

a. a generally enclosed container capable of holding a quantity of liquid toner, said container having a top wall having a concave arcuate shaped recessed portion at least a portion of which is electrically conductive, the curvature of said recessed portion conforming to the curvature of the arcuate path, said container being positioned such that said top wall portion of the container is concentric with, close to and uniformly spaced from the arcuate path to define a uniform toning gap between said top wall portion and said arcuate path, said top wall portion having an elongate slot;

b. a feed roller rotatably mounted within said container and capable of at least partial immersion within the liquid toner, said feed roller extending out into said slot for directing liquid toner into said uniform gap, the distance between said feed roller and said arcuate path being selected to allow passage of the image bearing surface through said gap without touching said roller or said top wall while said feed roller and the axis of said arcuate path are aligned along a vertical plane taken through the center of said slot.

7. In an electrophotographic copying apparatus of the type including an electrophotographic belt mounted for rotational movement on a plurality of support rollers, a developing device for developing a latent electrostatic image formed on the outer surface of the belt as the surface containing the image is passing over one of the support rollers, the developing device comprising:

a. a container positioned adjacent to but spaced from the circumference of said support roller and capable of holding a quantity of liquid toner, the container having a top wall including a recessed portion;

b. an arcuate shaped development electrode as a part of the recessed portion of said top wall, the curvature thereof conforming to the curvature of said support roller and defining a uniform gap between the upper surface thereof and the belt as the belt travels in an arcuate path over said support roller;

c. an elongate through slot formed in said electrode and top wall; and d. a feed roller rotatably mounted in the container and positioned to communicate with said slot so as to transport liquid toner thereon from the interior of the container to the development electrode surface to fill said gap in the vicinity of the belt at the support roller, said support roller and said feed roller arranged with their longitudinal axes aligned in a vertical plane taken through the center of said slot.

8. The device of claim 7 wherein opposite edges of said top wall bordering said slot are arcuately beveled to present an arcuate surface facing the circumferential surface of said feed roller and concentric therewith.

9. A method of developing a latent electrostatic image formed on the image bearing surface of an electrophotographic belt with liquid toner as said surface is moved through an arcuate path comprising:

a. positioning a development electrode having an arcuate surface whose curvature conforms to the curvature of the arcuate path such that the arcuate surface is concentric with, close to but uniformly spaced from said arcuate path, the space between the arcuate surface of the development electrode and the arcuate path defining thereby a toning gap therebetween;

b. transporting liquid toner from a supply to said toning gap by means of a feed roller as the belt is passing through the gap;

c. immersing the feed roller within the liquid toner, spacing the feed roller sufficiently close to said development electrode to enable feed of said liquid toner to said gap in the absence of engagement of said feed roller with said arcuate surface of said image bearing surface; and d. said method including the additional step of applying clear insulating liquid to the image bearing surface of the electrophotographic belt just prior to entry thereof into said toning gap whereby to prewet said surface, said insulating liquid being the same as that carrying the toner particles of said liquid toner.

* * * * *